United States Patent [19]

Doliber et al.

[11] 4,373,269

[45] Feb. 15, 1983

[54] ADJUSTMENT MECHANISM

[75] Inventors: Darrel L. Doliber; O'Dell M. Keil, both of Tempe, Ariz.

[73] Assignee: Litton Systems Inc., Beverly Hills, Calif.

[21] Appl. No.: 202,911

[22] Filed: Nov. 3, 1980

[51] Int. Cl.[3] ..... F41G 1/38

[52] U.S. Cl. ..... 33/246; 33/248; 74/89.15; 350/559

[58] Field of Search ..... 33/245, 246, 247, 248; 350/10; 74/89.15

[56] References Cited

U.S. PATENT DOCUMENTS

| | | | |
|---|---|---|---|
| 1,704,059 | 3/1929 | Packard, Jr. | 33/246 |
| 2,078,858 | 4/1937 | Kuhn | 350/10 |
| 2,087,996 | 7/1937 | Rarey | 33/248 |
| 2,208,913 | 7/1940 | Unertl | 33/248 |
| 2,479,789 | 8/1949 | Street | 350/10 |
| 3,058,391 | 10/1962 | Leupold | 33/246 |
| 3,297,389 | 1/1967 | Gibson | 33/245 |
| 3,788,430 | 1/1974 | Hurt | 74/89.15 |
| 3,990,155 | 11/1976 | Akin, Jr. et al. | 33/246 |
| 4,200,355 | 4/1980 | Williams, Jr. | 33/246 |

*Primary Examiner*—Richard R. Stearns

[57] ABSTRACT

An adjustment mechanism particularly for a weapon sight system that has one or more adjustment knobs which are readily accessible to an operator for a selected adjustment yet which are fully protected from accidental adjustment.

13 Claims, 6 Drawing Figures

ADJUSTMENT MECHANISM

BACKGROUND OF THE INVENTION

The efficient operation of a machine frequently depends upon the proper adjustment of one or more of its machine parts. This requirement for proper adjustment has resulted in the invention of a variety of adjusting devices that move a machine part or parts to a selected position. These adjusting devices are therefore generally well known in the prior art, and include those that permit horizontal center adjustment, leveling adjustments, radial arm adjustments, and the like; in sum, adjustments for any movable machine part.

Knobs and levers are frequently used in these adjusting devices so that the adjustable machine part can be moved to its desired position by the selected movement of the associated knob or lever. Where a knob is used, this selected movement can be accomplished by rotation of the knob. It is apparent, however, that unwanted movement can also be accomplished by rotation of the knob. For example, this can result from an accidental bump to the knob. Since an exposed knob is more likely to be accidently bumped, the prior art has recognized the continuing need to protect the exposed knob. Knobs are either recessed, which can be partial or total, or covered, again either partial or total, or the like to minimize or eliminate this risk. These protective measures have not been totally successful, and often have made it very difficult for an operator to rotate a protected knob.

While the present invention can find use in any one or more of these prior art adjusting devices, it does find particular use in an adjusting device for the sights on a weapon. It is, therefore, described for use in the specific embodiment of an adjusting device or adjustment mechanism for a telescopic sight on a rifle. Usually, these adjustment mechanisms depend upon knobs that can be rotated clockwise and counterclockwise to make a desired adjustment in the sight relative for example, to elevation and windage.

OBJECTS OF THE INVENTION

Accordingly, it is an object of the invention to provide a new and improved adjustment mechanism that is both readily accessible to an operator for a selected adjustment and fully protected from accidental adjustment.

It is an object of the invention to provide an adjustment mechanism that cannot be readily disassembled by an operator.

It is an object of the invention to provide an adjustment mechanism that cannot be accidently bumped and thereby change a selected adjustment.

It is an object of the invention to provide an adjustment mechanism that requires the removal of no parts prior to a selected adjustment.

It is an object of the invention to provide an adjustment mechanism that is readily accessible yet minimizes the possibility of foreign matter entering into and fouling the adjustment mechanism.

SUMMARY OF THE INVENTION

Briefly, in accordance with the invention, a new and improved adjustment assembly is provided for the movement of a non-rotatable member to a selected position. The adjustment assembly has a housing enclosing the non-rotatable member, a rotatable drive gear in the housing for rotation in a selected direction, a limited access aperture in the housing to permit the insertion of a lever to rotate the drive gear, and a non-rotatable driven member which is connected to the driven member, engaged by the rotatable drive gear for lateral movement relative to the drive gear when the drive gear is rotated.

While the specification concludes with claims particularly pointing out and distinctly claiming the subject matter which may be regarded as the invention, the organization and method of operation, together with further objects, features, and the attending advantages thereof, may best be understood when the following description is read in connection with the accompanying drawing.

DESCRIPTION OF THE INVENTION

Figure 1:
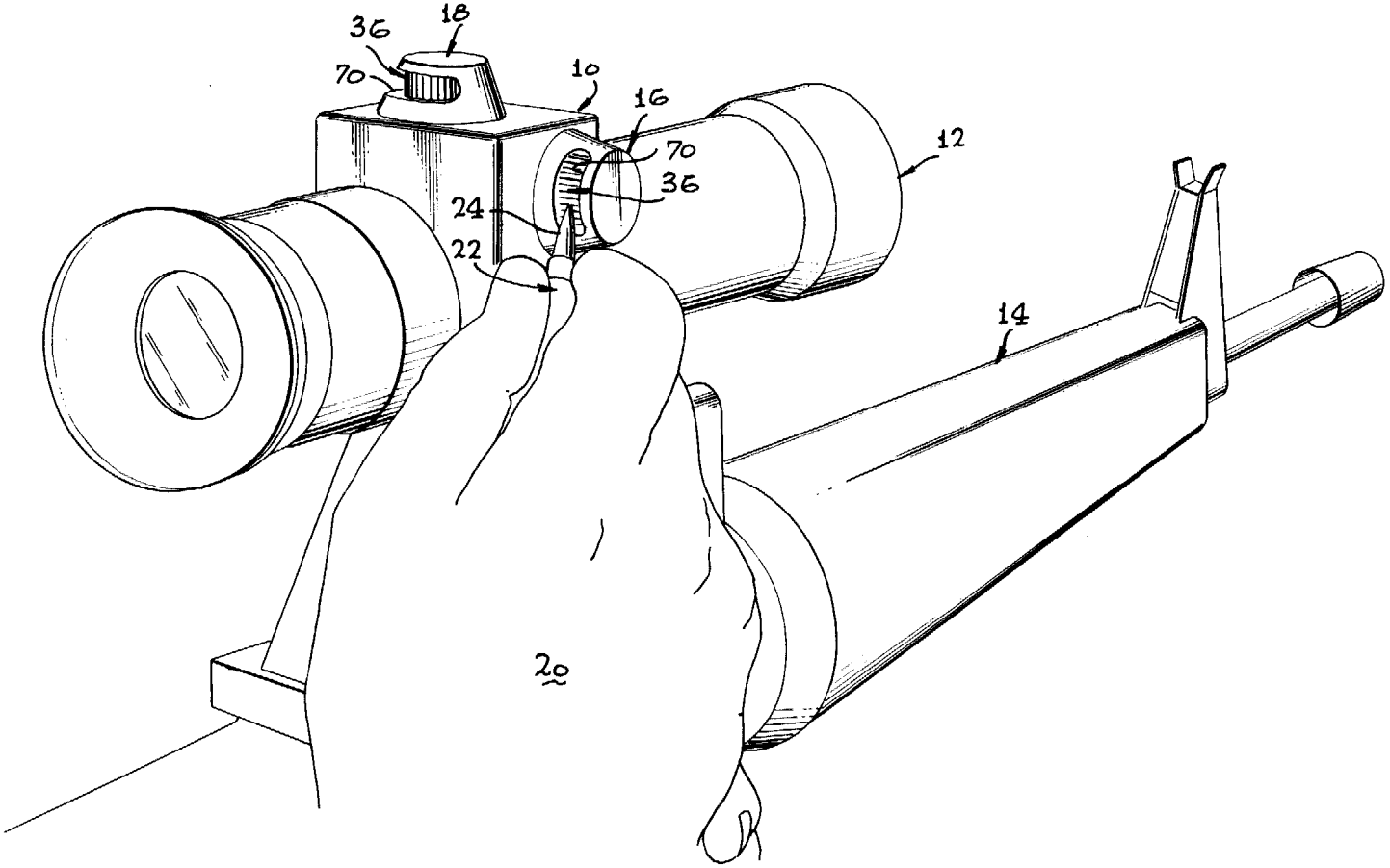
FIG. 1 is a perspective view of a weapon sight system wherein the adjustment assembly of the invention can find use.

The adjustment assembly 10 of the invention as shown by FIG. 1 can find particular use in a weapon sight system 12 which is shown as a telescopic sight. The telescopic sight 12 is mounted on a weapon 14; here a rifle. A conventional weapon sight requires adjustment for azimuth (including windage) and elevation so that the sight is accurately matched to the ballistics of the weapon and, if necessary, to correct for wind condition. Azimuth and elevation adjustments are made by the adjustment assembly 10 at the respective protuberances 16 and 18. An operator's hand 20 holds a rifle cartridge 22 that is positioned for the insertion of the elongated bullet end 24 of the cartridge into the azimuth protuberance 16 where the cartridge functions as a lever to actuate the azimuth correction through the adjustment assembly 10.

Figure 2:
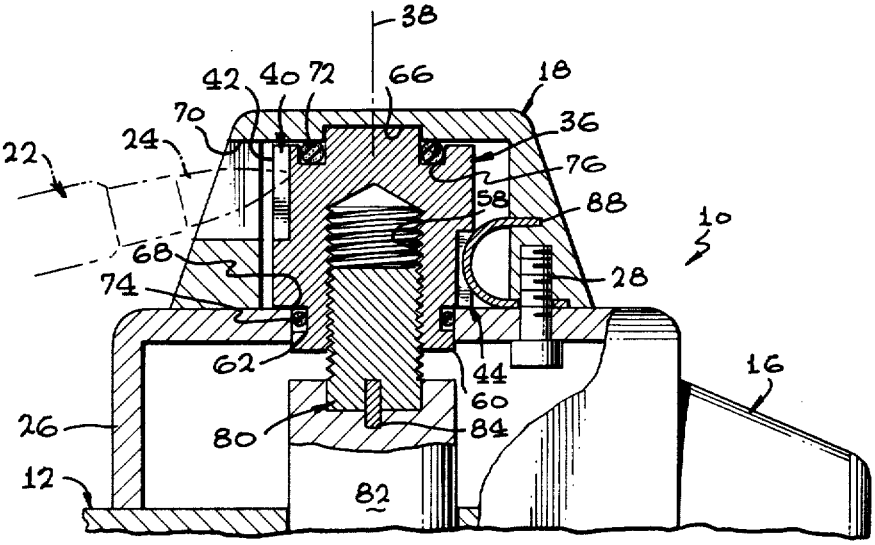
FIG. 2 is an elevation view in longitudinal section, partly broken away, of the adjustment assembly of FIG. 1.
Figure 3:
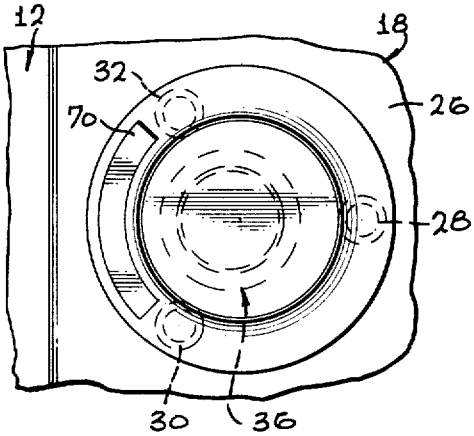
FIG. 3 is a plan view of a cap member of the adjustment assembly of FIG. 2.

Referring to FIGS. 2 and 3, the elevation protuberance 18 is an elevation adjustment cap that is removably fastened to a housing member 26 by similar fasteners 28, 30, and 32; fasteners 30 and 32 shown in phantom by FIG. 3. These fasteners, as shown by fastener 28 in FIG. 2, are accessible only from the interior of the housing member 26. This accessibility is possible only prior to fastening the housing member 26 to the weapon sight system 12. Thus, the adjustment assembly 10 of which the housing member 26 is a functional part, itself becomes an integral and functional part of the weapon sight system when so assembled and fastened together. The internal fastening of the elevation adjustment cap 18, which fastening is similar for the azimuth adjustment cap 16, prevents the accidental and/or unwanted removal of either or both of the caps from the weapon sight system 12 during normal use of the weapon and weapon sight system combination.

Figure 4:
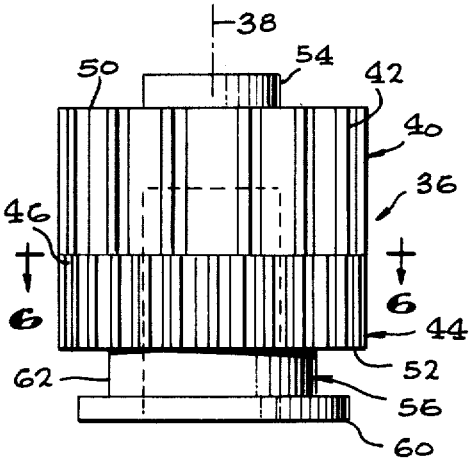
FIG. 4 is an elevation view of a gear member of the adjustment assembly of FIG. 2.
Figure 5:
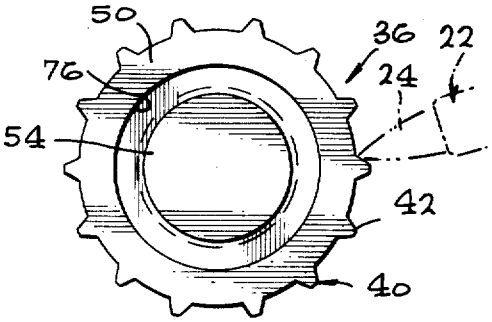
FIG. 5 is an end view of the gear member of FIG. 4.

A drive gear 36 for the adjustment assembly 10 of the invention has a longitudinal axis of rotation 38 as shown by FIG. 4. The drive gear has a greater gear portion 40, as shown by FIGS. 4 and 5, with gear teeth 42 having a circular pitch particularly adapted for engagement by an actuating lever such as the bullet end 24 of rifle cartridge 22. The drive gear 36 has a lesser gear portion 44, as shown by FIGS. 4 and 5, with gear teeth 46 having a circular pitch particularly adapted for engagement by a spring loaded detent, not shown, which will be described hereinafter with reference again to FIG. 2. It is contemplated that the gear teeth on the greater gear portion can have a circular pitch equal to or less than the circular pitch of the gear teeth on the lesser gear portion.

Figure 6:
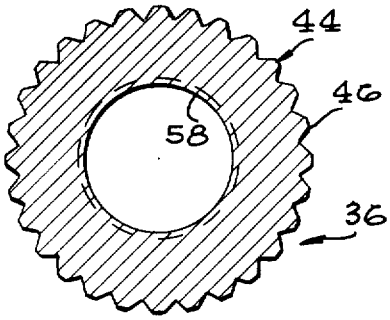
FIG. 6 is a sectional view of the gear member of FIG. 4 along the line 6—6.

Drive gear 36 as shown by FIG. 4 has parallel and spaced apart bearing surfaces 50 and 52 with respective stub shafts 54 and 56 that extend longitudinally and outwardly from the associated bearing surfaces. Stub shaft 56 is a hollow shaft having a blind bore 58 with an internal thread as schmatically shown by FIGS. 5 and 6. A radially extending lip edge 60 of stub shaft 56 is spaced apart from the bearing surface 52 by an annular groove 62.

Referring again to FIG. 2, drive gear 36 is assembled within the adjustment assembly 10 between the adjustment cap 18 and the housing member 26. A journal recess 66 in the adjustment cap 18 receives stub shaft 54 of the drive gear 36, while a clear hole 68 in the housing member 26 receives hollow stub shaft 56. This journal support of the drive gear 36 permits it to be rotated about its longitudinal axis 38 by an actuating lever.

The adjustment cap 18 has a limited access aperture 70 as shown by FIGS. 2 and 3 that is sized to permit the ready insertion of the bullet end 24 of the rifle cartridge 22 (shown in phantom). The rifle cartridge 22 functions as an actuating lever to selectively rotate drive gear 36 by the engagement of the bullet end 24 with the greater gear portion 40. Since a rifle cartridge is readily available to the operator of the weapon, it is preferred that the access aperture 70 be sized in this particular embodiment of the adjustment assembly 10 to permit the desired ready insertion of the bullet end of the rifle cartridge into the adjustment cap.

Although the access aperture 70 permits this ready insertion of the rifle cartridge, it also permits contaminants to enter the adjustment cap 18. Suitable bearing seals 72 and 74 are placed in an annular groove 76 formed in the bearing surface 50 of drive gear 36, and in annular groove 62, respectively. The bearing seals serve as contaminant barriers to prevent outside dust, water, and the like from entering the rotating and working components of the adjustment assembly 10 of FIG. 2.

A plunger or movable core 80 has an external thread that mates with the internal thread of the blind bore 58 in drive gear 36 as shown by FIG. 2. A non-rotatable member 82, which is a conventional part of the weapon sight system 12 where the adjustment assembly 10 of the invention can find use, is connected to the core 80 by a suitable key 84. This connection prevents the core 80 from rotating with the rotatable drive gear 36. The core 80, therefore, is constrained to a longitudinal motion into and out of the blind bore 58 relative to the longitudinal axis 38 by the associated rotation of the drive gear 36 when it is actuated as described hereinbefore. Inadvertent rotation of the drive gear 36 as the result of shock, vibration, and the like is prevented by a detent 88, which can be either a wire spring as shown by FIG. 2, or a spring-loaded ball detent (not shown), or the like. The audible clicks as the detent 88 snaps in-and-out over the gear teeth 46 of the lesser gear portion 44 assists the operator in making any necessary adjustments to the azimuth and elevation settings of the weapon sight system.

As will be evidenced from the foregoing description, certain aspects of the invention are not limited to the particular details of construction as illustrated, and it is contemplated that other modifications and applications will occur to those skilled in the art. It is, therefore, intended that the appended claims shall cover such modifications and applications that do not depart from the true spirit and scope of the invention.

We claim:

1. An adjustment assembly particularly suitable for actuation by a lever, comprising:

(a) a housing member;

(b) a cap member connected to said housing member;

(c) rotatable drive means constrained between said cap member and said housing member, said drive means capable of being selectively rotated by said lever;

(d) a limited access aperture in said cap member sized to permit insertion of said lever into said cap member for rotation of said drive means; and (e) non-rotatable driven means engaged by said drive means, said driven means exhibiting movement substantially parallel to the axis of rotation of said drive means when said drive means is rotated.

2. The adjustment assembly of claim 1 in which said housing member includes a detent means having a spring action continuously urging said detent means into engagement with said rotatable drive means so that unwanted rotation of said drive means is prevented.

3. The adjustment assembly of claim 2 in which said rotatable drive means includes a drive gear having a first gear portion adapted for engagement by the lever, and a second gear portion adapted for engagement by said detent means.

4. The adjustment assembly of claim 3 in which said first and second gear portions individually have a plurality of gear teeth where the gear teeth of said first gear portion have a circular pitch different than the circular pitch of the gear teeth of said second gear portion.

5. The adjustment assembly of claim 1 in which said rotatable drive means has a journal support in said housing member.

6. The adjustment assembly of claim 5 in which said rotatable drive means is a drive gear having a blind bore that extends along said rotational axis and that has an internal thread, and said non-rotatable driven means is a movable core that has an external thread for engagement with said internal thread of said blind bore so that the resulting thread engagement drives said movable core along said blind bore upon rotation of said drive means.

7. The adjustment assembly of claim 5 in which a seal means coacts with said journal support of said rotatable drive means so that said seal means serve as said rotatable drive means so that said seal means serve as contaminant barriers to any contaminants that enter said housing member through said limited access aperture.

8. The adjustment assembly of claim 1 in which said limited access mean is an access aperture sized to permit the ready insertion of the lever into said housing member.

9. The adjustment assembly of claim 1 in which said cap member is fastened to said housing member by at least one fastener accessible from the interior of said housing member such that the resulting assembly of said cap member and said housing member is secure from an unwarranted disassembly of said cap member from said housing member.

10. The adjustment assembly of claim 1 further comprising a non-rotatable member connected to said non-rotatable driven means.

11. The adjustment assembly of claim 10 in which said driven means is connected to said non-rotatable member by a key member.

12. In a sighting system, an adjustment assembly particularly suitable for activation by a lever comprising:

(a) a housing member;

(b) a pair of cap members connected to said housing member;

(c) a pair of rotatable drive means, wherein each of said drive means is constrained between a respective one of said cap members and said housing member, each of said drive means capable of being selectively rotated by said lever;

(d) a limited access aperture in each of said cap members sized to permit the insertion of said lever into said cap members for independent rotation of each of said drive means; and (e) a pair of non-rotatable driven means, each engaged by a respective one of said drive means, each of said driven means exhibiting independent movement substantially mutually perpendicular to a sighting axis when said respective one of said drive means is rotated.

13. The adjustment assembly of claim 12 in which each of said cap members is fastened to said housing member by at least one fastener accessible from the interior of said housing member such that the resulting assembly of said cap member and said housing member is secure from an unwanted disassembly of said cap member from said housing member.

* * * * *